US009167366B2

(12) United States Patent
Valentine et al.

(10) Patent No.: US 9,167,366 B2
(45) Date of Patent: Oct. 20, 2015

(54) THRESHOLD-DERIVED FITTING METHOD FOR FREQUENCY TRANSLATION IN HEARING ASSISTANCE DEVICES

(71) Applicant: Starkey Laboratories, Inc., Eden Prairie, MN (US)

(72) Inventors: Susie Valentine, Savage, MN (US); Kelly Fitz, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 61 days.

(21) Appl. No.: 13/931,436

(22) Filed: Jun. 28, 2013

(65) Prior Publication Data

US 2014/0119583 A1 May 1, 2014

Related U.S. Application Data

(60) Provisional application No. 61/720,795, filed on Oct. 31, 2012.

(51) Int. Cl.
*H04R 25/00* (2006.01)

(52) U.S. Cl.
CPC ..... *H04R 25/70* (2013.01); *H04R 25/353* (2013.01); *H04R 25/552* (2013.01)

(58) Field of Classification Search
CPC ..... H04R 25/353
USPC ..... 381/316
See application file for complete search history.

(56) References Cited

U.S. PATENT DOCUMENTS

| | | | | |
|---|---|---|---|---|
| 6,240,195 | B1 | 5/2001 | Bindner et al. | |
| 7,248,711 | B2 * | 7/2007 | Allegro et al. | 381/316 |
| 7,757,276 | B1 | 7/2010 | Lear | |
| 8,000,487 | B2 * | 8/2011 | Fitz et al. | 381/316 |
| 2010/0067721 | A1 * | 3/2010 | Tiefenau | 381/313 |
| 2011/0249843 | A1 * | 10/2011 | Holmberg et al. | 381/316 |

FOREIGN PATENT DOCUMENTS

| | | | |
|---|---|---|---|
| EP | 1959713 | B1 | 10/2009 |
| EP | 2375782 | A1 | 10/2011 |

OTHER PUBLICATIONS

Alexander, Joshua; "Frequency Lowering in Hearing Aids"; presented on Mar. 31, 2012; 2012 ISHA Convention; http://www.islha.org/Resources/Documents/Alexander%202012%20Frequency%20Lowering.pdf.*

* cited by examiner

*Primary Examiner* — Curtis Kuntz
*Assistant Examiner* — Ryan Robinson
(74) *Attorney, Agent, or Firm* — Schwegman Lundberg & Woessner, P.A.

(57) ABSTRACT

Disclosed herein, among other things, are apparatus and methods for a threshold-derived fitting rationale using frequency translation for hearing assistance devices. In various method embodiments, a first audiogram is received for a first hearing assistance device for a wearer, and a second audiogram is received for a second hearing assistance device for the wearer. The first audiogram and the second audiogram are compared to audiometric thresholds to determine if frequency translation should be enabled.

15 Claims, 2 Drawing Sheets

THRESHOLD-DERIVED FITTING METHOD FOR FREQUENCY TRANSLATION IN HEARING ASSISTANCE DEVICES

RELATED APPLICATION(S)

The present application claims the benefit of priority under 35 U.S.C. §119(e) to U.S. Provisional Application No. 61/720,795 filed on Oct. 31, 2012, which is incorporated herein by reference in its entirety

TECHNICAL FIELD

This document relates generally to hearing assistance systems and more particularly to threshold-based fitting using frequency translation for hearing assistance devices.

BACKGROUND

Hearing assistance devices, such as hearing aids, are used to assist patient's suffering hearing loss by transmitting amplified sounds to ear canals. In one example, a hearing aid is worn in and/or around a patient's ear. Hearing aids are intended to restore audibility to the hearing impaired by providing gain at frequencies at which the patient exhibits hearing loss. In order to obtain these benefits, hearing-impaired individuals must have residual hearing in the frequency regions where amplification occurs. In the presence of "dead regions", where there is no residual hearing, or regions in which hearing loss exceeds the hearing aid's gain capabilities, amplification will not benefit the hearing-impaired individual.

Individuals with high-frequency dead regions cannot hear and indentify speech sounds with high-frequency components. Amplification in these regions will cause distortion and feedback. For these listeners, moving high-frequency information to lower frequencies could be a reasonable alternative to over amplification of the high frequencies. Frequency translation (FT) algorithms are designed to provide high-frequency information by lowering these frequencies to the lower regions. The motivation is to render audible sounds that cannot be made audible using gain alone.

There is a need in the art for improved threshold-based fitting using frequency translation for hearing assistance devices.

SUMMARY

Disclosed herein, among other things, are apparatus and methods for a threshold-derived fitting rationale using frequency translation for hearing assistance devices. In various method embodiments, a first audiogram is received for a first hearing assistance device for a wearer, and a second audiogram is received for a second hearing assistance device for the wearer. The first audiogram and the second audiogram are compared to audiometric thresholds, in various embodiments. Frequency translation is enabled in the first and second hearing assistance devices if the first audiogram and the second audiogram meet or exceed the audiometric thresholds, and frequency translation is disabled in the first and second hearing assistance devices if the first audiogram or the second audiogram do not meet or exceed the audiometric thresholds. If frequency translation is enabled, parameters for frequency translation are set based on the first and second audiograms.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter.

DETAILED DESCRIPTION

Figure 1:
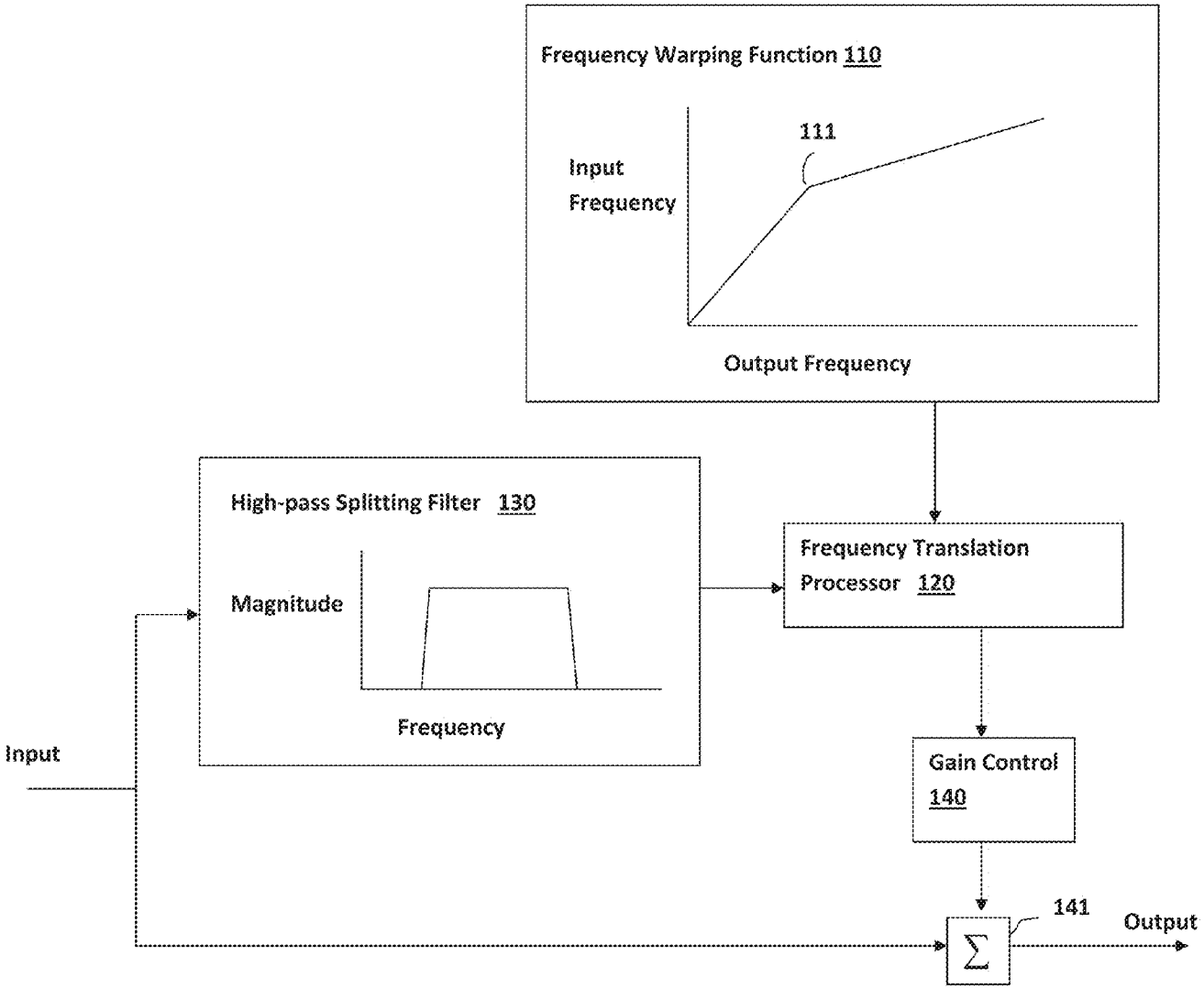
FIG. 1 shows a block diagram of a frequency translation algorithm, according to one embodiment of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

The present subject matter relates to fitting of hearing assistance devices for patients, and more particularly to automatically prescribing and fitting frequency translation parameters only for patients whose audiometric thresholds, for both right and left ear devices, suggest that they will receive benefit from frequency translation processing. Previous solutions include enabling frequency translation algorithms for all patients by default, or disabling frequency translation algorithms for all patients by default. Frequency translation is a dynamic filtering algorithm that constantly reacts to changes in the input signal. Two kinds of temporal smoothing are applied to prevent objectionable artifacts during abrupt changes in the input signal: the spectral envelope spectral envelope peak estimates are smoothed, and the level balancing gain adjustments are smoothed.

Disclosed herein, among other things, are apparatus and methods for a threshold-derived fitting rationale using frequency translation for hearing assistance devices. In various method embodiments, a first audiogram is received for a first hearing assistance device for a wearer, and a second audiogram is received for a second hearing assistance device for the wearer. The first audiogram and the second audiogram are compared to audiometric thresholds, in various embodiments. Frequency translation is enabled in the first and second hearing assistance devices if the first audiogram and the second audiogram meet or exceed the audiometric thresholds, and frequency translation is disabled in the first and second hearing assistance devices if the first audiogram or the second audiogram do not meet or exceed the audiometric thresholds. If frequency translation is enabled, parameters for frequency translation are set based on the first and second audiograms.

The present subject matter analyzes and interprets features of the patient's audiogram and recommends enabling or disabling frequency translation accordingly. The recommendation is based on the thresholds in both ears instead of fitting the ears independently. When the recommendation is made to enable frequency translation, an appropriate range of parameter configurations is made available in the fitting software, also according to features of the audiogram. The present subject matter considers the hearing loss in both ears when determining whether to enable frequency translation and what range of parameters is appropriate. A different range of fitting parameter settings is determined for each candidate patient, depending on their audiogram.

According to one embodiment, candidates for frequency translation should meet the following criteria:

1. Hearing Loss (HL) must be worse than 65 dB HL at least one frequency below 4000 Hz, and at all frequencies above 4000 Hz
2. HL must be better than 60 dB HL at frequencies 750 Hz and lower
3. For at least one octave the slope must equal or exceed 25 dB HL/octave
4. If both ears are aided then both ears should meet the FT criteria, even if asymmetry exists between the ears.

In the case of a bilateral fitting, both left and right audiometric thresholds are used to compute best-fit frequency translation parameters. If only one ear is being fit, then only the thresholds for that ear are used. Frequency translation parameters are initially computed identically for both ears in a bilateral fitting. According to various embodiments, FT parameters are fit based on two audiogram features: the "corner frequency", and the 70 dB HL frequency. The corner frequency of a sloping audiogram is the frequency at which the slope becomes steep, the edge of the low-frequency better-hearing region, in various embodiments. According to various embodiments, we estimate the corner frequency as the lowest frequency at which the slope exceeds 20 dB per octave. If the audiogram never achieves that slope, then we use instead the lowest frequency at which the maximum slope is achieved in an embodiment. The 70 dB point is the frequency at which hearing loss reaches 70 dB HL. These two features relate to two different possible embodiments or rationales for fitting Frequency Translation parameters to a patient's audiogram. In one embodiment, parameters are chosen such that a peak near the lower edge of the translation source region (in frequency) is mapped to the upper edge of the patient's good-hearing region. In another embodiment, parameters are chosen such that a peak near the middle or upper edge of the translation source region (in frequency) is mapped to the upper edge of the patient's aid-able hearing region. Other embodiments and rationales are possible without departing from the scope of the present subject matter. The present subject matter combines these two strategies to derive a variety of parameters that offer a range of adjustment to allow for individual differences in perceived benefit and sound quality.

Fitting controls include a selection of at least five parameter sets that span a range from mild to aggressive, in various embodiments. Parameters are computed for both ears in a bilateral fitting, using the corner frequency and 70 dB frequency computed for each ear in an embodiment. A range of knee frequency/warping ratio pairs is computed that translates a peak found at 2500 Hz to each of the corner frequencies in various embodiments. Another range of knee frequency/warping ratio pairs is computed that translates a peak found at 5500 Hz to each of the 70 dB frequencies, in an embodiment. From these parameters, a "strong" pair and a "mild" pair are chosen. The "strong" settings have the lowest knee frequency of all the computed parameter pairs, and the highest warping ratio among parameter sets having that lowest knee frequency. This pair corresponds to the most aggressive translation among the computed settings. The mild settings have the highest knee frequency of all the computed parameter pairs, and the lowest warping ratio among parameter sets having that highest knee frequency. This pair corresponds to the least aggressive translation among the computed settings. It is expected that most patients will be fit in this range of parameters, in various embodiments. It may additionally be desirable to extend the range of parameters to include "very strong" and "very mild" settings beyond the range described above.

Separate UI controls for the individual parameters of the frequency translation algorithm would be too burdensome for a non-expert user. In various embodiments, a single controller is used that adjusts the settings of the knee frequency, warping ratio, and split frequency all at once, according to "strength" or "aggressiveness" of processing. This control spans a range of discrete settings from very strong to very mild processing, computed according to the patient's audiogram, allowing a reasonable range of adjustment to the patient's taste. This range can be re-sampled at any desired resolution to obtain more intermediate settings, in various embodiments. In one embodiment, no fewer than five settings are offered.

The present subject matter uses audiograms from both ears of the wearer to set frequency translation parameters. According to various embodiments, parameters are computed for both ears in a bilateral fitting, using the corner frequency and the 70 db frequency computed for each ear. In various embodiments, a range of knee frequency/warping ratio pairs is computed that translates a peak found at 5500 Hz to each of the 70 db frequencies. From all of these parameters, a strong pair and a mild pair are chosen, in an embodiment. The strong settings have the lowest knee frequency of all the computed pairs, and the highest warping ratio among parameter sets having that lowest knee frequency. This pair corresponds to the most aggressive translation among the computed settings. The mild settings have the highest knee frequency of all computed parameter pairs, and the lowest warping ratio among parameter sets having the highest knee frequency. This pair corresponds to the least aggressive translation among the computed settings, in various embodiments.

FIG. 1 shows a block diagram of a frequency translation algorithm, according to one embodiment of the present subject matter. The input audio signal is split into two signal paths. The upper signal path in the block contains the frequency translation processing performed on the audio signal, where frequency translation is applied only to the signal in a highpass region of the spectrum as defined by highpass splitting filter 130. The function of the splitting filter 130 is to isolate the high-frequency part of the input audio signal for frequency translation processing. The cutoff frequency of this highpass filter is one of the parameters of the algorithm, referred to as the splitting frequency. The frequency translation processor 120 operates by dynamically warping, or reshaping the spectral envelope of the sound to be processed in accordance with the frequency warping function 110. The warping function consists of two regions: a low-frequency region in which no warping is applied, and a high-frequency warping region, in which energy is translated from higher to lower frequencies. The input frequency corresponding to the breakpoint in this function, dividing the two regions, is called the knee frequency 111. Spectral envelope peaks in the input signal above the knee frequency are translated towards, but not below, the knee frequency. The amount by which the poles are translated in frequency is determined by the slope of the frequency warping curve in the warping region, the so-called warping ratio. Precisely, the warping ratio is the inverse of the slope of the warping function above the knee frequency. The signal in the lower branch is not processed by frequency translation. A gain control 140 is included in the upper branch to regulate the amount of the processed signal energy in the final output. The output of the frequency translation processor, consisting of the high-frequency part of the input signal having its spectral envelope warped so that peaks in the envelope are translated to lower frequencies, and scaled by a gain control, is combined with the original, unmodified signal at summer 141 to produce the output of the algorithm.

The output of the frequency translation processor, consisting of the high-frequency part of the input signal having its spectral envelope warped so that peaks in the envelope are translated to lower frequencies, and scaled by a gain control, is combined with the original, unmodified signal to produce the output of the algorithm, in various embodiments. The new information composed of high-frequency signal energy translated to lower frequencies, should improve speech intelligibility, and possibly the perceived sound quality, when presented to an impaired listener for whom high-frequency signal energy cannot be made audible.

Figure 2:
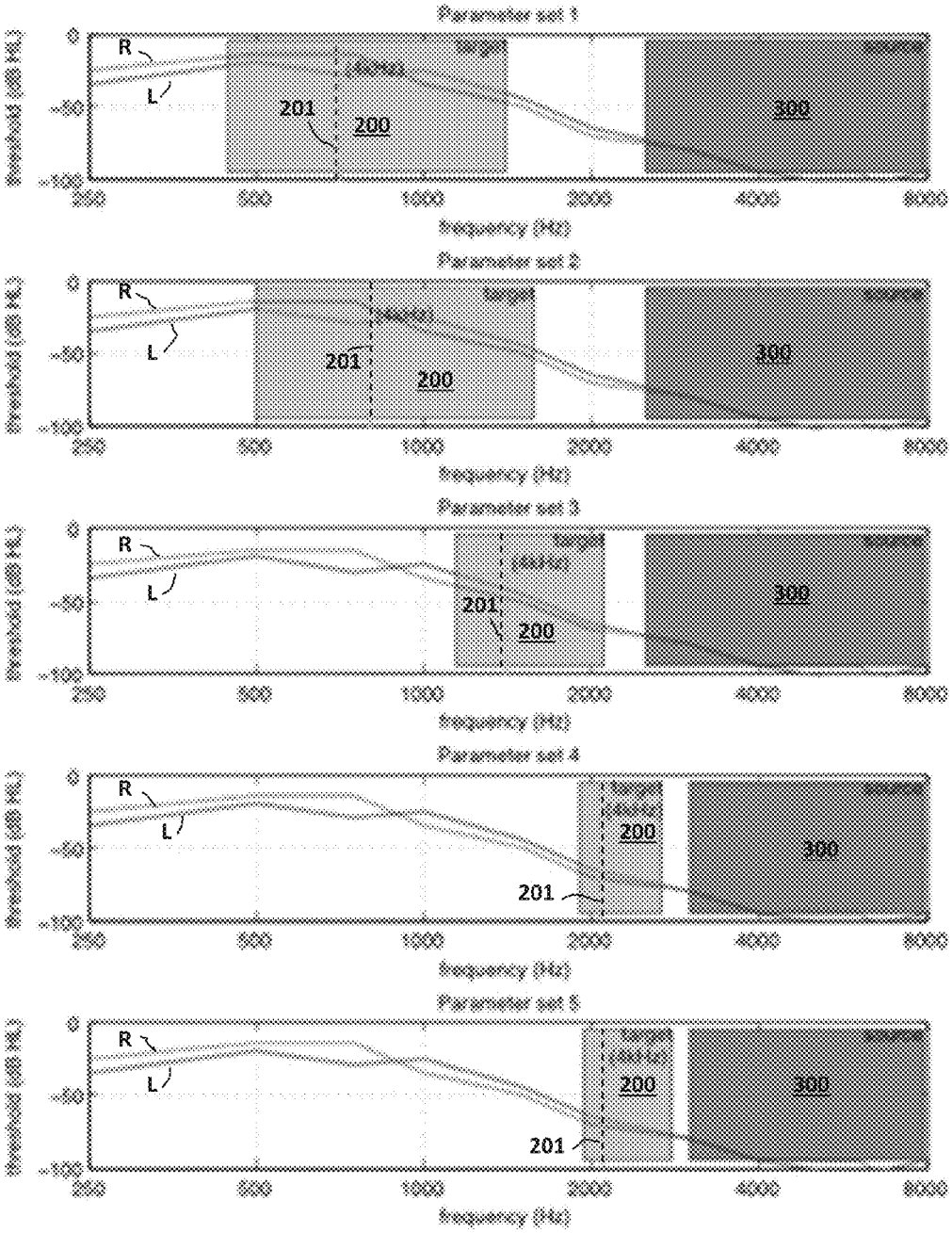
FIG. 2 shows a parameter settings computed for a wearer's audiogram, according to one embodiment of the present subject matter.

FIG. 2 shows a parameter settings computed for a wearer's audiogram, according to one embodiment of the present subject matter. Parameter settings are computed for a subject's first and second (i.e., corresponding to right and left ears) audiograms designated as R and L, respectively. The settings span a range from "very strong" (Parameter set 1) to "very mild" (Parameter set 5). Translation source and target ranges are depicted for each setting. For each parameter set, a target region 200 and a source region 300 are shown. Frequency components of the input signal in the source region are translated into the target region by the frequency translation algorithm. The vertical dashed line 201 in each of the parameter sets indicates the translated frequency corresponding to a hypothetical peak in the input signal found at 4 kHz.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method, comprising:

receiving a first audiogram for a first hearing assistance device for a wearer;

receiving a second audiogram for a second hearing assistance device for the wearer;

comparing the first audiogram and the second audiogram to audiometric thresholds;

enabling frequency translation in the first and second hearing assistance devices if the first audiogram and the second audiogram meet or exceed the audiometric thresholds;

disabling frequency translation in the first and second hearing assistance devices if the first audiogram or the second audiogram do not meet or exceed the audiometric thresholds;

if frequency translation is enabled, setting parameters for frequency translation based on the first and second audiograms; and, estimating a corner frequency for each of the first and second audiograms as the lowest frequency at which the slope of the audiogram exceeds 20 dB per octave and computing frequency translation parameters such that a peak found at 2500 Hz is translated to the corner frequency.

2. The method of claim 1 wherein the audiometric thresholds for enabling frequency translation include a hearing loss worse than 65 dB at least one frequency below 4000 Hz, and at all frequencies above 4000 Hz.

3. The method of claim 2 wherein the audiometric thresholds for enabling frequency translation include a hearing loss better than 60 dB HL at frequencies 750 Hz and lower.

4. The method of claim 2 wherein the audiometric thresholds for enabling frequency translation include, for at least one octave, the slopes of the first and second audiograms must equal or exceed 25 dB of hearing loss per octave.

5. The method of claim 1 further comprising computing of a range of knee frequency/warping ratio pairs that translates a peak found at 2500 Hz to each of the corner frequencies.

6. The method of claim 5 further comprising grouping the computed knee frequency/warping ratio pairs from mildest to strongest translation processing, wherein a mildest pair is one having the highest knee frequency of all the computed pairs and the lowest warping ratio among pairs having that highest knee frequency and wherein a strongest pair is one have the lowest knee frequency of all the computed pairs and the highest warping ratio among pairs having that lowest knee frequency.

7. The method of claim 6 further comprising providing a user interface control for setting frequency translation parameters that adjusts the settings of the knee frequency, warping ratio, and split frequency all at once according to strength of translation processing.

8. A method, comprising:

receiving a first audio gram for a first hearing assistance device for a wearer;

receiving a second audiogram for a second hearing assistance device for the wearer;

comparing the first audiogram and the second audiogram to audiometric thresholds;

enabling frequency translation in the first and second hearing assistance devices if the first audiogram and the second audiogram meet or exceed the audiometric thresholds;

disabling frequency translation in the first and second hearing assistance devices if the first audiogram or the second audiogram do not meet or exceed the audiometric thresholds;

if frequency translation is enabled, setting parameters for frequency translation based on the first and second audiograms; and, if the slope of the first or second audiogram never exceeds 20 dB per octave, estimating a corner frequency of the audiogram as the lowest frequency at which the maximum slope is achieved and computing frequency translation parameters such that a peak found at 2500 Hz is translated to the corner frequency.

9. The method of claim 8 further comprising computing a range of a range of knee frequency/warping ratio pairs that translates a peak found at 2500 Hz to each of the corner frequencies.

10. The method of claim 9 further comprising grouping the computed knee frequency/warping ratio pairs from mildest to strongest translation processing, wherein a mildest pair is one having the highest knee frequency of all the computed pairs and the lowest warping ratio among pairs having that highest knee frequency and wherein a strongest pair is one have the lowest knee frequency of all the computed pairs and the highest warping ratio among pairs having that lowest knee frequency.

11. The method of claim 10 further comprising providing a user interface control for setting frequency translation parameters that adjusts the settings of the knee frequency, warping ratio, and split frequency all at once according to strength of translation processing.

12. A method, comprising:

receiving a first audio gram for a first hearing assistance device for a wearer;

receiving a second audiogram for a second hearing assistance device for the wearer;

comparing the first audiogram and the second audiogram to audiometric thresholds;

enabling frequency translation in the first and second hearing assistance devices if the first audiogram and the second audiogram meet or exceed the audiometric thresholds;

disabling frequency translation in the first and second hearing assistance devices if the first audiogram or the second audiogram do not meet or exceed the audiometric thresholds;

if frequency translation is enabled, setting parameters for frequency translation based on the first and second audiograms; and, estimating a 70 dB frequency for each of the first and second audiograms as the frequency at which hearing loss reaches 70 dB and computing frequency translation parameters such that a peak found at 5500 Hz is translated to each of the 70 dB frequencies.

13. The method of claim 12 further comprising computing a range of a range of knee frequency/warping ratio pairs that translates a peak found at 5500 Hz to each of the 70 dB frequencies.

14. The method of claim 13 further comprising grouping the computed knee frequency/warping ratio pairs from mildest to strongest translation processing, wherein a mildest pair is one having the highest knee frequency of all the computed pairs and the lowest warping ratio among pairs having that highest knee frequency and wherein a strongest pair is one have the lowest knee frequency of all the computed pairs and the highest warping ratio among pairs having that lowest knee frequency.

15. The method of claim 14 further comprising providing a user interface control for setting frequency translation parameters that adjusts the settings of the knee frequency, warping ratio, and split frequency all at once according to strength of translation processing.

* * * * *